US008616129B1

(12) United States Patent
Barrow et al.

(10) Patent No.: US 8,616,129 B1
(45) Date of Patent: Dec. 31, 2013

(54) CARTRIDGE ACTUATOR AND METHOD OF MANUFACTURE THEREOF

(75) Inventors: Ryan Barrow, Swan Point, MD (US); James Mackie-Smith, Hughesville, MD (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 20 days.

(21) Appl. No.: 13/137,477

(22) Filed: Aug. 19, 2011

(51) Int. Cl.
*F42B 5/02* (2006.01)
*F42B 5/16* (2006.01)
*F42C 9/10* (2006.01)

(52) U.S. Cl.
USPC ..... 102/464; 102/275.11; 102/277.1; 102/277.2; 102/439

(58) Field of Classification Search
USPC ..... 102/439, 443, 448, 464, 277, 277.1, 102/277.2, 275.11, 447
See application file for complete search history.

(56) References Cited

U.S. PATENT DOCUMENTS

RE18,252 E * 11/1931 Alden ..... 102/436
3,102,478 A * 9/1963 Cook ..... 102/448
3,734,020 A * 5/1973 Ciccone et al. ..... 102/443
3,820,463 A * 6/1974 Leonard et al. ..... 102/436
3,897,729 A * 8/1975 Schirneker ..... 102/439
3,994,233 A * 11/1976 Travor et al. ..... 102/277.2
4,024,819 A * 5/1977 Schirneker ..... 102/430
4,381,692 A 5/1983 Weintraub
5,003,879 A * 4/1991 Jones ..... 102/204
5,031,541 A * 7/1991 Gardner et al. ..... 102/443
5,131,329 A 7/1992 Lips et al.
6,564,720 B1 * 5/2003 Meyer et al. ..... 102/522
6,708,619 B2 3/2004 Tota et al.
2008/0184907 A1 * 8/2008 Casas ..... 102/464

* cited by examiner

*Primary Examiner* — James Bergin
(74) *Attorney, Agent, or Firm* — Fredric J. Zimmerman

(57) ABSTRACT

A cartridge useful as an activator of other systems, and related method of manufacture. The cartridge's casing includes a fuse delimited by placing a plate at each end staked to the casing for fixing the fuse. This configuration permits precise control of the length of the fuse during manufacture, eliminates the need for separate structures in the casing to aid fuse location, and simplifies manufacture and assembly. This configuration supports the fuse lessening stresses that can lead to fractures. A portion of the casing is thinned by a preselected amount to permit fracturing of the casing to launch the projectile. The projectile may be attached to the cartridge casing more simply, e.g. by screw threading.

10 Claims, 2 Drawing Sheets

CARTRIDGE ACTUATOR AND METHOD OF MANUFACTURE THEREOF

STATEMENT OF GOVERNMENT INTEREST

The invention described herein may be manufactured and used by or for the Government of the United States of America for Governmental purposes without the payment of any royalties thereon or therefor.

FIELD OF THE INVENTION

The invention pertains to the structure and manufacture of cartridge shells, particularly cartridges used as activators of other systems.

BACKGROUND

Cartridge shells are sometimes used as activators for other devices, e.g. to release a projectile terminated by a knife edge so as to cut a lanyard and release a payload thethered to the lanyard. Such a cartridge shell may typically have a casing with the projectile attached thereto, with the casing having a central opening in which is disposed an explosive charge to fire the projectile, and a fuse to transmit ignition from a primer cap to the explosive charge. The length and composition of the fuse determines what delay occurs between firing of the cap and ignition of the charge, and the mechanism by which the projectile attaches to the cartridge determines at what gas pressure within the cartridge causes release of the projectile. A delay between firing the primer and launching the projectile is advantageous for the systematic deployment of an applicable systems or payloads. In this manner, the burn time of the fuse determines the delay time between firing of the cartridge and the release of the projectile. Assembling the fuse at the proper length, however, can be difficult. To do so, one typically forms a portion of the cartridge's central opening into a ledge, and forms the fuse by stacking chemical energetics into the central opening up to the ledge. In practice, it is difficult to determine precisely how closely the height of the energetics stack registers with the ledge, requiring extra manufacturing steps to verify fuse position before fixing the fuse in place, for example by adhesive.

Also, at the opposite end of the fuse near the explosive charge, the casing has another ledge upon which rests and physically supports the fuse. This means that the fuse is not fully supported at its base, which gives rise to shearing forces and bending moments that can fracture the fuse, and cause failure of the cartridge.

SUMMARY OF THE INVENTION

Accordingly, an object of the invention is to permit the precise control of the delay time at which a cartridge releases its projectile.

Another object is to do the foregoing by precise control of the cartridge's fuse length.

Another object is to prevent mechanical fracturing of the fuse prior to firing the cartridge.

Another object is to prevent such mechanical fracturing by fully supporting the fuse in the cartridge's interior.

Another object is to do the foregoing in a manner that simplifies and makes more reliable the manufacturing of such cartridges.

Another object is to do the foregoing by permitting simple, easy, hand attachment of the projectile to the cartridge casing.

In accordance with these and other objects made apparent hereinafter, the invention concerns a cartridge having several advantageous features. Instead of supporting the fuse adjacent the explosive charge, a cartridge according to the invention may use a staked plate to support the fuse. The plate being mechanically fixed in the cartridge interior by several protuberances that are sharp enough to cut into the sides of the cartridge's casing, so as to mechanically fix the plate in place, and provide a platform on which the fuse may rest. Thus, this arrangement reduces the shear forces and bending moments at the base of the fuse. At the opposite end of the fuse, one may dispense with the ledge that demarcates the length of the fuse, and instead use a staked plate to fix, more precisely, in place the top of the fuse. This arrangement makes the length (and burning time) of the fuse more precisely controllable during manufacture. This embodiment further simplifies casing manufacture because, by removing this ledge, the central opening in the casing may now have a constant diameter.

These and other objects are further understood from the following detailed description of particular exemplary embodiments of the invention. It is understood, however, that the invention is capable of extended application beyond the precise details of these exemplary embodiments. Changes and modifications may be made to the exemplary embodiments, that do not affect the spirit of the invention, nor exceed its scope, as expressed in the appended claims. The exemplary embodiments are described with particular reference to the accompanying drawings, wherein:

DETAILED DESCRIPTION OF THE INVENTION

Figure 1A:
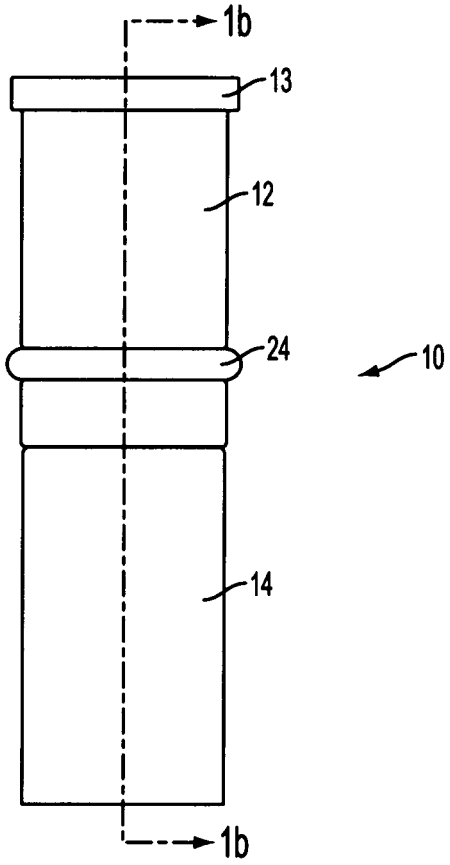
FIG. 1*a* is an elevational view of an embodiment according to the invention.
Figure 1B:
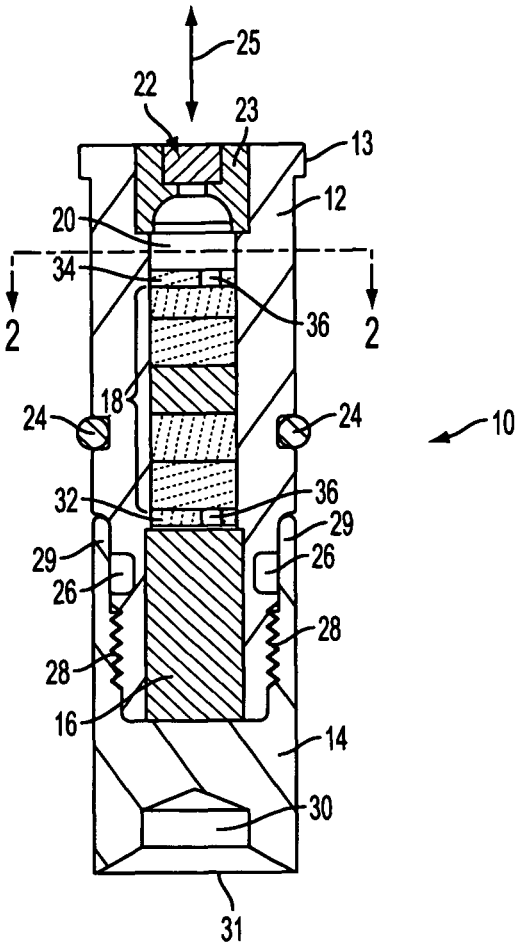
FIG. 1*b* is a sectional view in the direction of lines 1*b*-1*b* of FIG. 1*a*.

With reference to the drawing figures, wherein like numbers indicate like parts throughout the several views, FIGS. 1*a* and 1*b* show a cartridge 10 having a casing 12 and a projectile 14 attached to casing 12 by screw threads 28. Casing 12 has a flange 13 to aid mounting cartridge 10 in a launch mechanism, e.g. a gun barrel, etc. Casing 12 has an interior space, or cavity, 20 in which resides an explosive charge 16, and a fuse 18 extending from the space containing containing explosive charge 16 to the opening 22 in casing 12. Interior space 20 extends generally along an elongate length 25, in which resides fuse 18, and mount 23 for primer cap 22. Fuse 18 is, in an exemplary embodiment, in the form of a stack of chemical energetics, which, because stackable, permits manufacture of the device of FIGS. 1*a* and 1*b* with a fuse of preselectable length. At distally opposite ends of fuse 18 are a pair of staked plates 32, 34 (seen better in FIGS. 2 and 3), having holes 36, 36' to permit communication of combustion products to space 20 and charge 16. Projectile 14 attaches to casing 12 by mating screw threads 28. Casing 12 has a portion 26 thinned by a preselected amount in comparison to the remainder of casing 12 that surrounds interior space 20. Thinned portion 26 lies above screw threads 28 immediately adjacent portion 29 of projectile 14, so that breakage of casing 12 at portion 26 will detach projectile 14 from casing 12. Inserted into the projectile 14 is attachment 30 having a relatively sharp, planar, bottom edge 31 for cutting anything at which cartridge 10 shoots projectile 14. Cartridge 10 also has o-ring 24 to contain barrel gases when cartridge 10 is fired, e.g. from a gun, rifle, cannon, or other device.

Figure 2:
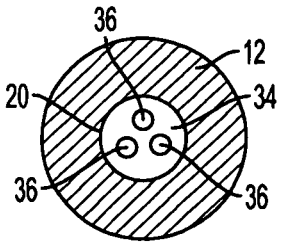
FIG. 2 is a sectional view in the direction of lines 2-2 of FIG. 1*b*.
Figure 3:
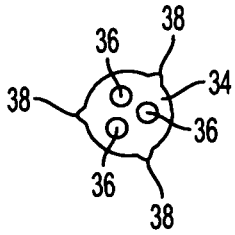
FIG. 3 is an elevational view of an exemplary staked plate, such as may be used in structures illustrated in the foregoing figures.

With particular reference to FIGS. 2 and 3, FIG. 2 shows staked plate 34 disposed in interior space 20 of casing 12, with holes 36 in plate 34 for communication of fire from primer cap 22 to fuse 18. FIG. 3 shows plate 34 separate from cartridge 10, and shows, in an exemplary embodiment, protuberances 38 in the form of small spikes. When in place as in FIGS. 1*b* and 2, the protuberances 38 may be cut into casing 12 in a direction transverse to elongate length 25 so as to fixedly mount staked plate 34 onto casing 12 inside interior space 20.

Casing 12 and projectile 28 may be made of any appropriate structural material, for example, aluminum, because of its relatively light weight compared to its mechanical strength. Knife insert 30 and edge 31 are, in an exemplary embodiment, made of steel to provide good cutting of targets. Primer cap 22 may be made of any appropriate ignition material used in small arms, for example, lead-styphnate. Similarly, the material of fuse 18 may be made of any pyrotechnic delay material. The propellant material in explosive charge 16 may be, for example, made of conventional black powder.

During assembly of cartridge 10, explosive charge 16 is placed within casing 12 in any conventional manner, and staked plate 32 placed atop it. Explosive charge 16 may be mounted at its end distally opposite of staking plate 32 in any conventional manner, e.g., by a ledge extending from casing 12 into interior space 20 (not shown in the drawing figures). Plate 32 may initially be curved slightly to fit within interior space 20, and pressed down along elongate direction 25 so that plate 32 splays, driving protuberances (like protuberance 38 of plate 34) into casing 14, fixing plate 32 in place. Thereafter, discs of energetics material 18 may be stacked upon plate 32, up to the desired level in interior space 20 along elongate length 25. Use of staked plate 34 permits more reliable placement of fuse 18 in interior space 20. Thus, in an exemplary embodiment, this configuration dispenses with the need of a ledge to delimit this end of fuse 18, and simplifies the manufacture of casing 12. This embodiment also permits better control of the gap in space 20 between primer cap 22 and fuse 18, which makes assembly of cartridge 10 yet simpler and more reliable.

In operation, cartridge 10 is loaded in a firing barrel, and triggered so as to fire primer cap 22. The ignition products pass into interior space 20 and holes 36 in staked plate 34, and ignite fuse 18. Fuse 18 burns through to staked plate 32, which ignites explosive charge 16 through holes 36'. The gas pressure fractures the thinned wall at portion 26 of casing 12 and the portion 29 of projectile 14 adjacent to portion 26. This fracture detaches projectile 14 from cartridge 10, and launches projectile 14, where knife edge 31 may cut the desired target. The length of fuse 18 is more precisely controllable due to the staked plates 32, 34. Further, the degree to which casing 12 is thinned at portion 26 is controllable.

In principle, the delay time between the firing of cap 22 and charge 16 may be changed by varying the height of column 18. It is, in an exemplary embodiment, possible to maintain the height of column 18 fixed in order to simplify the manufacture of cartridge 10, and selectably vary delay time by selectably varying the chemical composition of fuse 18.

The invention has been described in what is considered to be the most practical and exemplary embodiments. It is recognized, however, that obvious modifications to these embodiments may occur to those with skill in this art.

Lastly, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A cartridge, comprising:

a casing comprising a wall being disposed about an interior space, said interior space extends along an elongate length;

an explosive charge being located within said interior space;

a fuse being disposed adjacent said explosive charge along said elongate length in said interior space, a length of said fuse along said elongate length is a preselected elongate length to affect a preselected burn time of said fuse; and a staked plate being disposed at a distally opposite end of said fuse from said explosive charge, wherein said staked plate includes protuberances disposed to cut into said wall effective to fix the position of said fuse along, and the length of said fuse in, said elongate length in said interior space, wherein said staked plate is a first staked plate, wherein said cartridge further comprises a second staked plate, wherein said second staked plate disposed at the end of said fuse adjacent to said explosive charge, wherein said second staked plate includes protuberances disposed to cut into said wall effective to mount said second staked plate in said interior space, and wherein said first staked plate and said second staked plate are together effective to mount said fuse in, and preselectedly delimit the length of, said fuse in said interior space.

2. The cartridge of claim 1, further comprising a projectile being attachable to said casing, wherein said casing includes a selected, thinned portion thinned by a preselected amount compared to the remainder of said casing effective to cause gas pressure within said interior space to cause separation of said projectile from said cartridge by breakage of said casing at said selected, thinned portion.

3. The cartridge of claim 1, further comprising a projectile being attachable to said casing, wherein said casing includes a selected, thinned portion thinned by a preselected amount to cause said separation at a preselected gas pressure within said interior space.

4. The cartridge of claim 1, further comprising a projectile being attachable to said casing, wherein said casing includes a selected, thinned portion thinned by a preselected amount to cause gas pressure within said interior space to cause separation of said projectile from said cartridge by breakage of said casing at said selected, thinned portion.

5. The cartridge of claim 4, wherein said preselected amount by which said casing is thinned is selected to cause said separation at a preselected gas pressure within said interior space.

6. The cartridge of claim 4, wherein said casing and said projectile have screw threads selected to permit said casing and said projectile to attach by screwing said projectile onto said casing.

7. The cartridge of claim 1, further comprising a projectile being attachable to said casing, wherein said casing and said projectile include screw threads selected to permit said casing and said projectile to attach by screwing said projectile onto said casing.

8. The cartridge of claim 1, further comprising a projectile being attachable to said casing, wherein said casing and said projectile include screw threads selected to permit said casing and said projectile to attach by screwing said projectile onto said casing.

9. A cartridge, comprising:

a casing comprising a wall being disposed about an interior space, said interior space extends along an elongate length;

an explosive charge being located within said interior space;

a fuse being disposed adjacent said explosive charge along said elongate length in said interior space; and a staked plate being disposed at the end of said fuse adjacent to said explosive charge, wherein said staked plate includes protuberances disposed to cut into said wall effective to mount said staked plate in said interior space effective to fix the position of said fuse adjacent said explosive charge in said interior space, wherein said staked plate is a first staked plate, wherein said cartridge further comprises a second staked plate, wherein said second staked plate disposed at the end of said fuse adjacent to said explosive charge, wherein said second staked plate includes protuberances disposed to cut into said wall effective to mount said second staked plate in said interior space, and wherein said first staked plate and said second staked plate are together effective to mount said fuse in, and preselectedly delimit the length of, said fuse in said interior space.

10. The cartridge of claim 9, further comprising a projectile being attachable to said casing, wherein said casing and said projectile include screw threads selected to permit said casing and said projectile to attach by screwing said projectile onto said casing.

* * * * *